US006832540B2

(12) United States Patent
Hart

(10) Patent No.: US 6,832,540 B2
(45) Date of Patent: Dec. 21, 2004

(54) LOCKING HYDRAULIC ACTUATOR

(76) Inventor: Kenneth E. Hart, 557 Granite Hills St., Simi Valley, CA (US) 93065

( * ) Notice: Subject to any disclaimer, the term of this patent is extended or adjusted under 35 U.S.C. 154(b) by 90 days.

(21) Appl. No.: 10/390,455

(22) Filed: Mar. 17, 2003

(65) Prior Publication Data

US 2004/0182235 A1 Sep. 23, 2004

(51) Int. Cl.[7] ..... F15B 15/26
(52) U.S. Cl. ..... 92/24
(58) Field of Search ..... 92/15, 20, 24, 92/25, 26, 27, 28

(56) References Cited

U.S. PATENT DOCUMENTS

| | | | | |
|---|---|---|---|---|
| 3,251,278 | A | | 5/1966 | Royster |
| 4,167,891 | A | | 9/1979 | Kamimura |
| 4,185,539 | A | | 1/1980 | Stratienko |
| 4,240,332 | A | | 12/1980 | Deutsch |
| 4,295,413 | A | | 10/1981 | Kamimura |
| 4,470,340 | A | | 9/1984 | Goans et al. |
| 4,526,058 | A | | 7/1985 | Runkel et al. |
| 4,712,471 | A | | 12/1987 | Johnson |
| 4,951,552 | A | | 8/1990 | Fox |
| 5,050,484 | A | | 9/1991 | Kamimura |
| 5,056,418 | A | | 10/1991 | Granger et al. |
| 5,063,828 | A | | 11/1991 | Kamimura |
| 5,081,910 | A | | 1/1992 | D'Ascenzo, Jr. |
| 5,095,808 | A | * | 3/1992 | Baldridge ..... 92/24 |
| 5,097,748 | A | | 3/1992 | Koch et al. |
| 5,184,465 | A | | 2/1993 | Howard et al. |
| 5,349,894 | A | | 9/1994 | Greer |
| 5,379,969 | A | | 1/1995 | Marx et al. |
| 6,059,228 | A | | 5/2000 | Koizumi et al. |
| 6,186,047 | B1 | | 2/2001 | Baruffaldi |

OTHER PUBLICATIONS

"Air Accidents Investigation Branch: Bulletins (Jan. 2002)," (Published Jan. 10, 2002), United Kingdom Air Accidents Investigation Branch, <http://www.aaib.dft.gov.uk/bulletin/jan 02/n631x.htm>.

* cited by examiner

*Primary Examiner*—Thomas E. Lazo
(74) *Attorney, Agent, or Firm*—Lesley A. Hamlin; Gregory Matthew McCloskey

(57) ABSTRACT

A locking hydraulic actuator has a cylinder and a main piston that is movable from an extend position to a retract position by a hydraulic circuit. The actuator has a locking mechanism that includes a lock piston that slides within a lock piston bore of the main piston. One or more lock segments are held by slots within the main piston and may be radially constrained within a tailstock housing and cylinder. The lock segments maintain the main piston in a locked position. The lock segments have two straight tapers, one on a proximal face and the other on a distal face, which transmit axial loading forces to and from the cylinder and main piston by distributed loading, thereby avoiding point-contact loading and material deformation. The lock piston, lock segments, piston, and cylinder may have different hardnesses.

41 Claims, 10 Drawing Sheets

LOCKING HYDRAULIC ACTUATOR

BACKGROUND

Hydraulic actuators, in which a piston fits within a cylinder and is forced to move along the cylinder by pressure differences in a fluid on either side of the piston, are used in a variety of applications. Hydraulic actuators are commonly used in the control of machines and structures that are subject to large forces. For example, these actuators are used on rotary and fixed-wing aircraft to counter and control the large forces that develop during the flight and landing of the aircraft. Hydraulic actuators may be used on such aircraft to provide position control of equipment such as nose wheel landing gear, main landing gear, speed brake control surfaces, and flap control surfaces.

For some applications such as those above, it may be desirable under certain conditions to lock the position of the piston of the hydraulic actuator at a particular location relative to the cylinder. Often one positional extreme or the other of the piston movement or "stroke" is selected. The positional extremes of the piston are sometimes referred to as the "extend position" and the "retract position." Such hydraulic actuators with locking capabilities are commonly referred to as locking hydraulic actuators or locking actuators.

Different locking mechanisms have been used to lock hydraulic actuators. Hydraulic actuators may be locked through hydraulic locking, which can result when the hydraulic fluid is prevented from flowing within the hydraulic circuit of the hydraulic actuator, thus preventing movement of the piston within the cylinder. This type of locking relies on the pressurization of the actuator and may not be reliable when pressure in the actuator is lost, which can occur when a leak occurs in the hydraulic circuit of the actuator, when the hydraulic pump that supplies fluid to the hydraulic actuator is non-operational, or when contaminants in the hydraulic fluid block passageways or components in the hydraulic system. A piston may also be locked within the cylinder of a hydraulic actuator by mechanically interlocking parts.

Problems result from mechanically locking the hydraulic actuator. Among these problems is that such locking mechanisms are prone to unlocking from a locked position after repeated loading or heavy use, due to excessive deformation of the locking mechanism parts. Unlocking may occur when parts in the locking mechanism become deformed due to loading conditions that exceed the yield strength of the material of the locking mechanism parts. Deformation typically occurs when such hydraulic actuators experience large axial loads, particularly such loads that are cyclic in nature, i.e., that alternate between tension and compression along the longitudinal axis of the hydraulic actuator. These types of loading conditions can occur in many different situations, including for example, within a piston actuator used in landing gear of an aircraft upon landing.

Information related to attempts to address these problems can be found in U.S. Pat. No. 4,167,891 and U.S. Pat. No. 4,295,413. However, each one of these references suffers from one or more of the following disadvantages: excessive deformation of slots in main piston under axial loading of the actuator, and propensity for rotation of lock segments wider such axial loading, with resulting possibility for failure of the locking mechanism in the actuator.

For the foregoing reasons, there is a need for a locking hydraulic actuator that is able to repeatedly withstand cyclic axial loading conditions in a locked position without considerable deformation of the locking mechanism components.

SUMMARY OF THE INVENTION

The present invention is directed to a locking hydraulic actuator that satisfies this need for the capability to repeatedly withstand cyclic loading conditions in a locked position without considerable deformation of the locking mechanism components, thereby avoiding deformation-induced failure of the locking mechanism and the resulting undesired unlocking of the hydraulic actuator.

A first embodiment of the present invention includes a locking hydraulic actuator including a cylinder having an inner radial surface, a longitudinal axis, and a cylinder stop surface. A main piston slides within the cylinder and has a lock piston bore with one or more slots passing from an outer radial surface to the lock piston bore. The main piston may include a main piston head, and the main piston head may have a main piston head diameter that is larger than that of the main piston. The cylinder may be connected to a tailstock housing. A lock piston slides within the lock piston bore from a first position to a second position in either direction along the longitudinal axis of the cylinder. The lock piston has a first section with a first diameter, and a second section with a second diameter greater than the first diameter. The lock piston may an intermediary section with a diameter that varies from the first diameter to the second diameter. An elastic coupler, which may be a spring, connects the main piston to the lock piston, and the spring tends to keep the lock piston preloaded in one direction. One or more lock segments are included. The lock segments slide within the slots and each lock segment has a proximal straight taper and a distal straight taper and a cylinder-abutting surface. The straight tapers may include an intersection of two flat faces of the lock segment. Each lock segment also may have an outer radial surface and an inner radial surface, a first and a second lateral face, and a proximal face and a distal face. The lock segments are radially moveable from a locked position where each of the cylinder-abutting faces contacts the cylinder stop surface and in which position the main piston is immovable along the actuator longitudinal axis to an unlocked position in which the main piston is movable along the longitudinal axis of the actuator.

A second embodiment of the present invention includes an improvement for a locking hydraulic actuator of the type in which a main piston is slidably disposed within a cylinder, and wherein the main piston has a lock piston slidably disposed within the main piston. This type of hydraulic actuator has one or more lock segments that are radially slidingly disposed within slots in the main piston and radially moveable from a locked position to an unlocked position. The improvement includes a proximal straight taper disposed on a proximal face of each lock segment, and a distal straight taper disposed on a distal face of each lock segment. The proximal straight taper transmits and distributes stresses from axial loads developed in the locking hydraulic actuator across the entire width of the lock segment to the proximal face of the slot. Similarly, the distal straight taper transmits and distributes stresses of the axial loads developed in the locking hydraulic actuator across the entire width of the lock segment to said distal face of each slot. The improvement may include the lock piston having a portion that contacts the one or more lock segments with a constant diameter while the lock segments are in a radially extended position in which the actuator is locked. The main piston may include a main piston head, and the main piston head may have a main piston head diameter that is larger than that of the main piston.

A third embodiment of the present invention includes a locking mechanism for a piston and cylinder assembly. The locking mechanism may include a lock piston slidingly disposed within the piston of the piston and cylinder assembly. The piston may include a piston head, and the piston head may have a piston head diameter that is larger than that of the piston. The lock piston has an intermediary section between a first section with a first diameter and a second section with a second diameter greater than the first diameter. Included are one or more lock segments that are placed in one or more corresponding slots disposed through the piston from an outer radial surface to an inner radial surface. Each of the one or more lock segments has a proximal face having a proximal straight taper, a distal face having a distal straight taper, and a width. Each of the one or more slots has a proximal face and a distal face. The lock piston is movable from a locked position to an unlocked position.

In the locked position, the second section of the lock piston rests radially inward of the inner radial faces of the lock segments. In the unlocked position, the first section rests radially inward of the inner radial faces of the lock segments. When the lock segments are in a locked position under axial loading conditions, the proximal straight taper transmits and distributes stresses arising from the axial loads developed in the piston and cylinder assembly across the width of the lock segment to the proximal face of the slot. Under the same conditions, the distal straight taper transmits and distributes stresses of across the width of the lock segment to the distal face of the slot. The one or more lock segments, in response to movement of the lock piston, are moveable radially from a locked position in which the piston is locked within the cylinder to an unlocked position in which the piston is moveable within cylinder. The lock piston second section may have a constant diameter.

The various embodiments of the present invention may also include a lock position indicator mechanism. The present invention may be used with different types of hydraulic control systems including but not limited to three-way and four-way electrohydraulic servo valves of the closed-center (overlap), open-center (under lap), or critical-center types (zero lap) and two-way and three-way solenoid valves. The present invention may also include one or more single-rod actuators or double-rod actuators and varying number of lock segments. In preferred embodiments, the portion of the main piston that includes the slots may have a diameter that is between five and ten thousands of an inch, i.e., mils, less than the diameter of the main piston head in the cylinder. Maximizing the diameter of the main piston in this manner increases the surface area of the slot faces and the area over which forces can be distributed to the lock segments. Also in preferred embodiments, the lock segments and the slots may have a clearance that is between one-half and three mils. By minimizing the clearance with the lock segments in this manner, lock segment rotation is minimized.

BRIEF DESCRIPTION OF THE DRAWINGS

These and other features, aspects, and advantages of the present invention will become better understood with regard to the following description, appended claims, and accompanying drawings. The drawings include the following:

DESCRIPTION

The present invention may be understood by the following detailed description, which should be read in conjunction with the attached drawings. The following detailed description of a hydraulic actuator and locking mechanism according to the present invention is by way of example only and is not meant to limit the scope of the present invention.

As used herein, the term "straight taper" includes reference to a straight line intersection of two flat faces. The term may also include reference to a surface that is beveled with respect to each of the two flat faces. The term may also include reference to a smoothed or rounded beveled surface as the interface between two flat surfaces. Additionally, the term "proximal" includes reference to a direction away from an extend position of a piston in a single-rod hydraulic actuator. For double-rod hydraulic actuators used with the present invention, the term "proximal" includes reference to a direction toward a neutral position of the hydraulic actuator. Furthermore, the term "distal" includes reference to a direction toward an extend position of a piston in a hydraulic actuator, whether of single-rod or double-rod type. Finally, the term "hardness" includes reference to a surface hardness of a material.

Figure 1A:
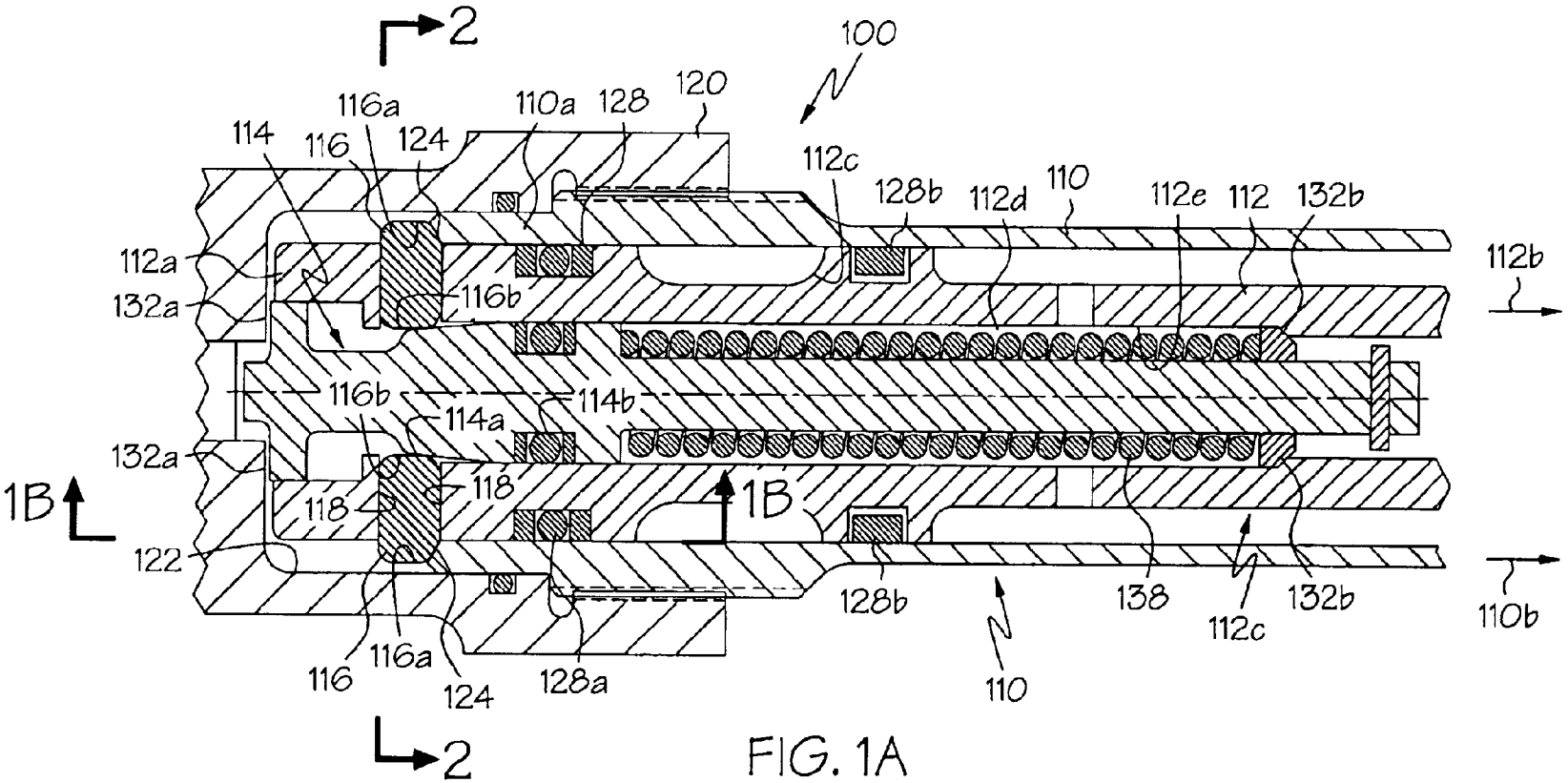
FIG. 1A (PRIOR ART)
FIG. 1A shows a cross section of a locking mechanism of the prior art.

A representative prior art locking hydraulic actuator will now be described. With reference to FIG. 1A, a cut away view is shown of a cross section of a typical locking mechanism 100 used in a prior art hydraulic actuator having a main piston and cylinder, each with proximal and distal ends. The locking mechanism shown is configured to lock mechanically in a retract position.

The prior art locking mechanism 100 includes a portion of a hydraulic cylinder 110 having a proximal end 110*a* and a distal end 110*b*, a portion of a main piston 112, a lock piston 114 and one or more lock segments 116. The one or more lock segments have outer 116*a* and inner 116*b* radial surfaces, and arc positioned within slots 118 in the main piston 112. The main piston 112 has a proximal end 112*a*, a distal end 112*b*, and an outer radial surface 112*c*. The main piston 112 also has a lock piston bore 112*d* defined by an inner radial surface 112*e*. The main piston 112 and the lock piston 114 are coupled together by a spring 138, which tends to preload the lock piston 114 in one direction and to keep the main piston 112 and lock piston 114 a distance apart. The lock piston 114 slides within the main piston 112, which slides within the cylinder 110. The cylinder 110 is connected to a tailstock housing 120 that has an inner radial surface 122 that contains the lock segments 116 within the locking mechanism 100 when the locking mechanism is in the locked position. The lock segments 116 are caused to move, radially relative to the actuator longitudinal axis, within the slots 118 by the lock piston 114 or a contact face 124 of the cylinder 110, depending on the motion of the lock piston 114. When the lock segments 116 are in the locked position corresponding to their outermost radial position within the tailstock housing 120, the main piston 112 is, under ideal conditions, fixed relative to the cylinder 110. The lock piston has a tapered portion 114*a* with a linearly varying diameter. The movement of the lock piston 114 is restrained by piston stops 132*a*, 132*b*.

During the operation of the prior art locking hydraulic cylinder, the pressure of the hydraulic fluid on one side of one or more main piston seals 128*a*, 128*b* increases. A resulting force is exerted on a portion of the surface area on the side of the main piston 112 that is subject to the increased pressure, and the main piston 112 then moves along the longitudinal axis of the hydraulic actuator. When the main piston 112 is forced to its retract position towards the tailstock housing 120, the spring 138 is compressed, and the lock piston 114 is pushed in the same retract direction. As the lock piston 114 is pushed by the main piston 112, the lock piston 114 slides under the lock segments 116, exerting a force on the lock segments 116 in an outward radial direction.

When the lock segments 116 slide past the proximal end 110*a* of the cylinder 110, the outer radial surface 116*a* of each lock segment 116 is allowed to move outside of the circumference of the main piston 112 due to the larger diameter presented by the inner radial surface 122 of the tailstock housing 120. As the lock piston 114 slides fully to the proximal end 110*a* of the cylinder 110, and the lock segments 116 are consequently pushed outward to their extreme radial position, the main piston 112 is prevented from moving by the contact of the lock segments 116 with the contact face 124 of the cylinder and the main piston contact with the piston stop 132*a*. As a result, the main piston 112 becomes locked in place.

To disengage the main piston 112, the pressure of the hydraulic fluid at the proximal end of the lock piston 114 and a lock piston seal 114*b* is increased, relative to the hydraulic fluid pressure on the distal side of the lock piston seal 114*b*. This increase in pressure causes an increase in the force tending to push the lock piston 114 toward the distal end of main piston 112, eventually moving the lock piston 114 and compressing the spring 138. When the lock piston 114, which underlies the lock segments 116 in a radial sense, is moved so that a smaller diameter of the lock piston underlies the lock segments 116, the lock segments 116 can be forced inward by the contact face 124 of the cylinder 110 to a point where the outer radial face 116*a* of each lock segment 116 is radially within the circumference of the main piston 112. As a result, the locking mechanism becomes unlocked, releasing the main piston 112 to move within the cylinder 110.

Figure 1B:
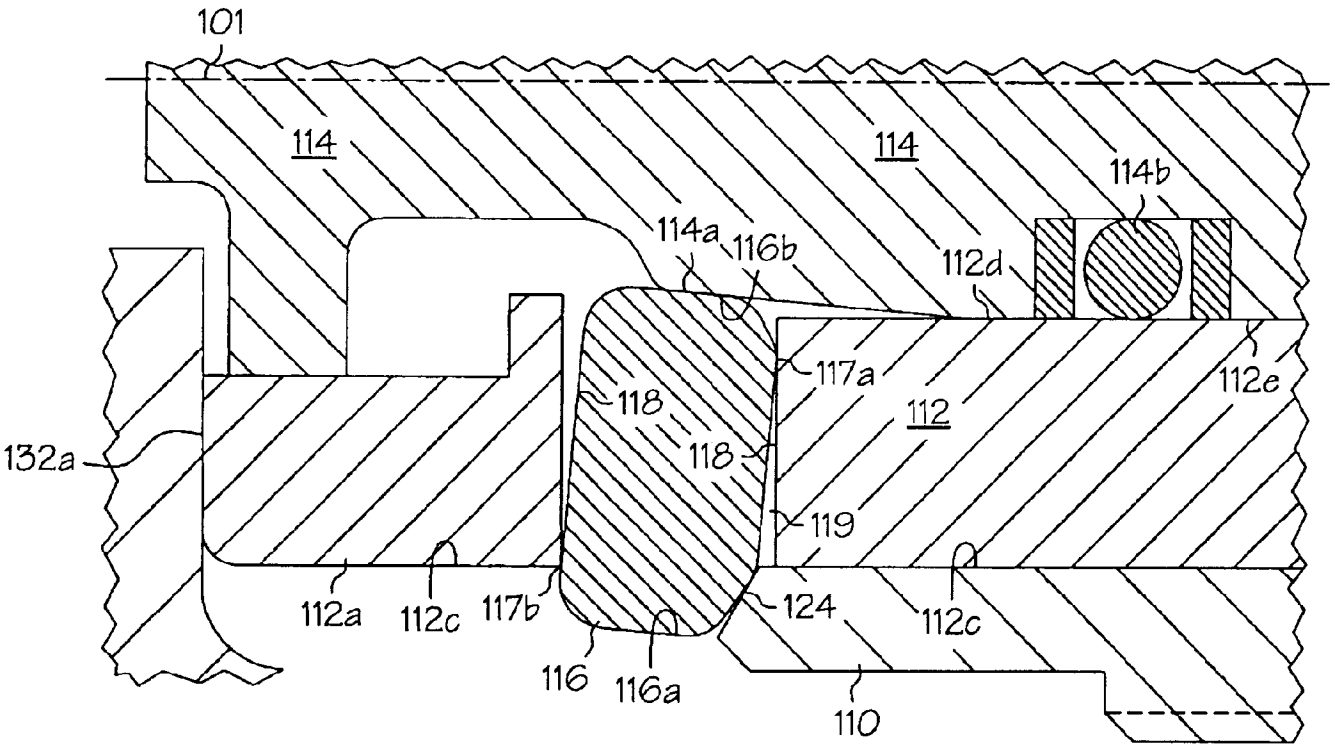
FIG. 1B (PRIOR ART)
FIG. 1B shows a cross section of a portion of the locking mechanism of FIG. 1A in a locked state under a tensile loading condition.

Referring to FIG. 1B, portions of the prior art locking mechanism 100 are shown under a tensile axial loading condition that is tending to pull the main piston 112 and cylinder 110 apart along their common, longitudinal axis 101. The locking mechanism is shown in a locked position with the lock segment 116 abutting the cylinder contact face 124. The lock piston 114 and lock piston seal 114*b* are shown in contact with the inner radial surface 112*e* of the main piston. The tailstock housing (not shown) is adjacent to the outer radial surface 116*a* of the lock segment 116. Due to the shape of the tapered portion 114*a* of the lock piston 114, the inner radial surface 116*b* of each of the lock segments 116 may move away from the longitudinal axis 101 of the actuator when the locking mechanism is locked and under tensile axial loading conditions. The lock segments 116 consequently tend to rotate within the main piston slots 118 under such loading conditions. A lock segment rotation 119 is shown for such an axial loading condition. Because the slots 118 are formed through the curved profile of the main piston 112 near the proximal main piston end 112*a*, the lock segments 116 may pivot or rock on at least two axes of rotation under such axial loading conditions including tensile and compressive loads. One axis of rotation 117*a* may develop along a chord connecting the ends of the curved profile within the slot 118, e.g., along a chord or line segment near the lock piston bore 112*d*. Another axis of rotation 117*b* may develop at the edge of the slot 118 on the outer radial surface 112*c* of the main piston 112.

Because the axial loads of the hydraulic actuator 100 are transmitted from the main piston 112 to the cylinder 110 through each lock segment 116 by as few as two points of contact for each lock segment 116, i.e., one on each of the proximal and distal sides of the lock segment 116, dangerous loading conditions such as point-contact loading can occur. Such point-contact loading can concentrate the axial forces the hydraulic actuator 100 experiences and may create stresses beyond the yield strength of the piston, cylinder, and locking mechanism materials. The resulting stresses can produce excessive deformation of (1) lock segment-to-cylinder surfaces such as the contact face 124, (2) lock segment-to-piston surfaces such as those of the slots 118 and radial main piston surfaces 112*c*, 112*e*, and/or (3) the lock segments 116. Such deformation, e.g., slot deformation, can lead to excessive lock segment rotation and is typically produced by tensile axial loading conditions. When the loading situation is reversed during cyclic loading, the opposite edge of the slot 118 is typically not deformed by lock the segments 116 because the piston 112 bottoms out at piston stop 132*a* which reacts to or counters reversing loads. The lock segment rotation 119 may cause the lock piston 114 to suddenly reposition or move within the lock piston bore 112*d*, thereby allowing the lock segments 116 to release contact with the cylinder contact face 124 and move radially inward within the slots 118. Under such conditions, the hydraulic actuator 100 can mechanically unlock. Machine failure, structural failure, and possibly injury or loss of human life can occur when such unintended unlocking occurs.

Figure 2:
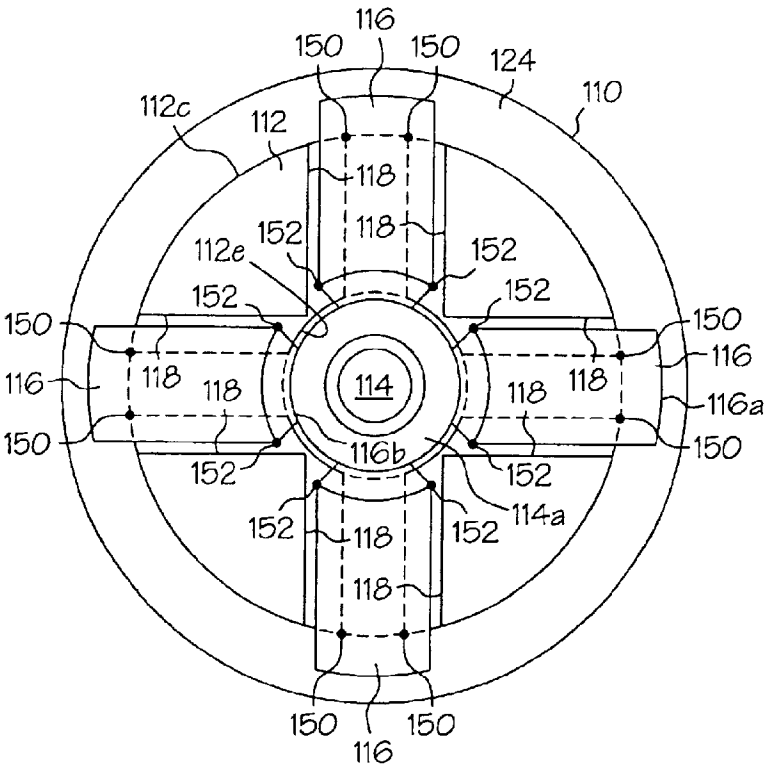
FIG. 2 ( PRIOR ART )
FIG. 2 shows a section view of the prior art locking mechanism of FIG. 1A taken along line 1—1.

FIG. 2 shows a section view of the prior art locking mechanism of FIG. 1A, taken along line 1—1. Four lock segments 116 are shown within an outer surface of the cylinder 110 and in radially extended positions relative to the lock piston 114. For each lock segment 116, the outer radial surface 116*a* is shown in relation to the cylinder 110 and the contact face 124. The inner radial surface 116*b* of each of the lock segments 116 is shown in contact with tapered portion 114*a* of the lock piston 114. For the prior art locking mechanism of FIG. 1, and for similar locking mechanisms, typical positions in the locking mechanism where deformation occurs are shown. For example, the relative position of points of outer slot deformation 150 on the outer radial surface 112*c* of the main piston 112 are shown Also shown are points or regions of slot face deformation 152 on the faces of the slots 118 near the inner radial surface of the 112*e* of the main piston 112.

Figure 3A:
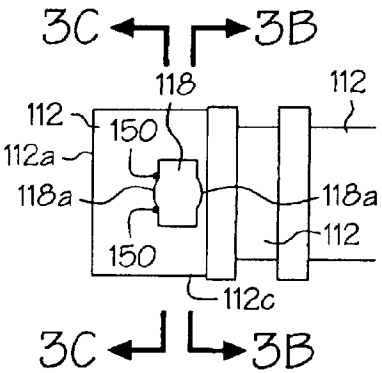
FIG. 3A ( PRIOR ART )
FIG. 3A shows a section view of the piston of the prior art locking mechanism of FIG. 1A taken along line 2—2.
Figure 3C:
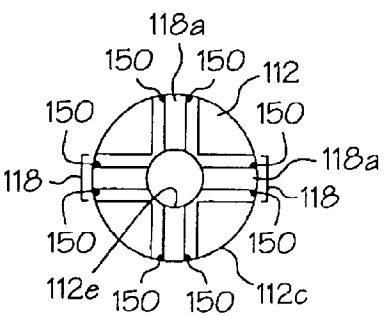
FIG. 3C ( PRIOR ART )
FIG. 3C shows a cross section of the piston of FIG. 3A taken along line 4—4.
Figure 3B:
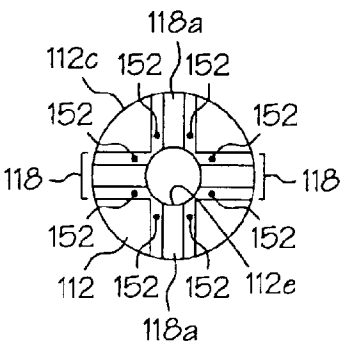
FIG. 3B ( PRIOR ART )
FIG. 3B shows a cross section of the piston of FIG. 3A taken along line 3—3.

Referring now to FIG. 3A, a section view is shown of the prior art locking mechanism of FIG. 1A taken along line 2—2. Slots 118 (one shown) are present in the main piston 112 and are shown having a curved surface 118*a*. The slots 118 connect the outer radial surface 112*c* of the main piston to the lock piston bore (not shown.) For point-contact loading conditions resulting from tensile axial loads within the hydraulic actuator, areas of deformation 150 on the outer radial surface 112*c* of the main piston are shown relative to the main piston proximal end 112*a*. FIG. 3B shows a cross section of piston 112 of FIG. 3A taken along line 3—3. Areas of deformation 152 associated with point-contact loading on the faces of the slots 118 are shown on either side of curved surfaces 118*a* of the slots 118. FIG. 3C shows a cross section of piston 112 of FIG. 3A taken along line 4—4. Areas of deformation 150 associated with point-contact loading on the outer radial surface 112*c* of the main piston 112 are shown on either side of curved surfaces 118*a* of the slots 118.

Figure 4A:
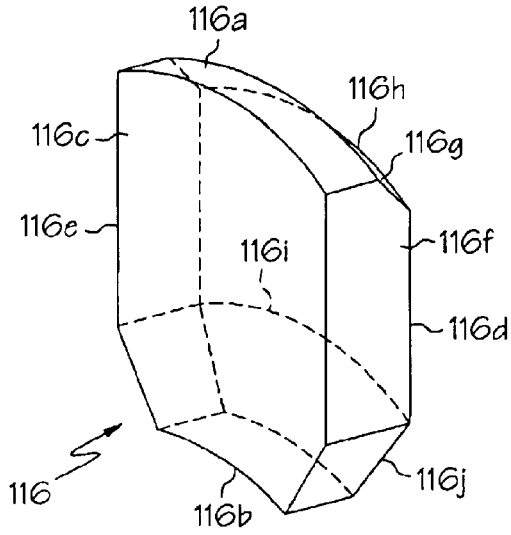
FIG. 4A ( PRIOR ART )
FIG. 4A shows a perspective view of one lock segment of the prior art locking mechanism of FIG. 1A.
Figure 4B:
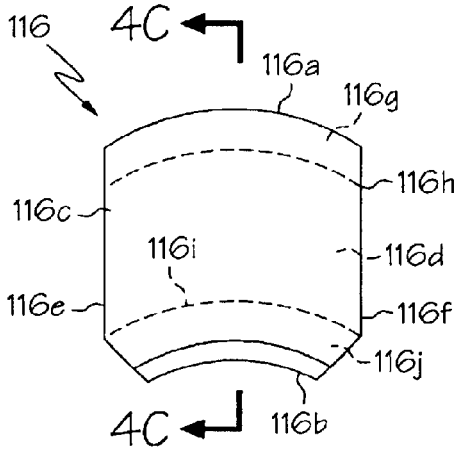
FIG. 4B ( PRIOR ART )
FIG. 4B shows a side view of the lock segment in FIG. 4A.
Figure 4C:
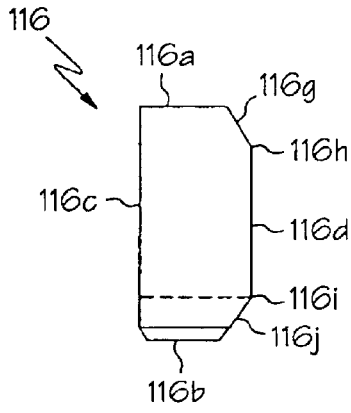
FIG. 4C ( PRIOR ART )
FIG. 4C shows a section view of the lock segment of FIG. 4B along section line 5—5.

FIG. 4A shows a perspective view of one lock segment 114 of the prior art locking mechanism of FIG. 1A. FIG. 4B shows a side view of the lock segment in FIG. 4A while FIG. 4C shows a section view of the lock segment of FIG. 4B along section line 5—5. In these figures, the lock segment 116 is shown as having an outer radial, inner radial, proximal and distal faces 116*a*, 116*b*, 116*c*, and 116*d*, respectively. The lock segment in the figures also has lateral sides 116*e*, 116*f*, and a cylinder engagement face 116*g*. A curved intersection 116*h* is present between the cylinder engagement face 116*g* and the distal face 116*d*. The lock segment 116 also has a curved intersection 116*l* between the distal face 116*d* and a lower distal face 116*j*.

Figure 5:
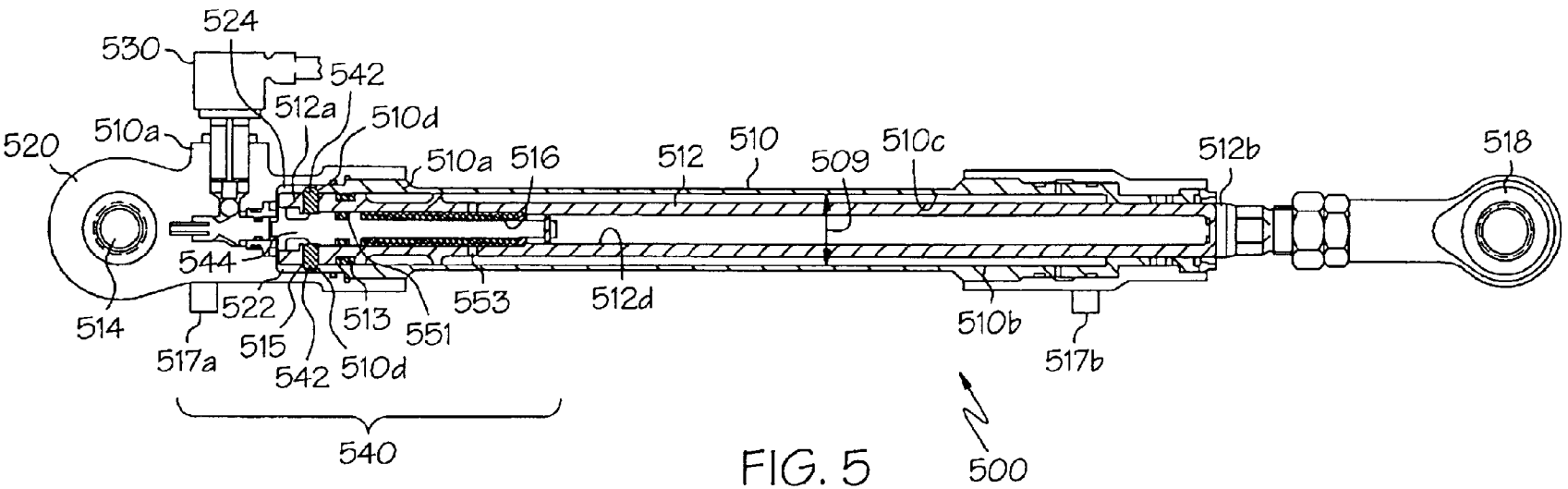
FIG. 5 is a cross section view of one embodiment of the present invention including a hydraulic actuator with a locking mechanism.

In contrast to the above-described prior art locking mechanism of FIGS. 1A–4C, the present invention includes a hydraulic actuator and a locking mechanism that avoid dangerous point-contact loading of the locking mechanism parts. Axial loads experienced by the actuator are transferred between the actuator and locking mechanism parts by distributed loading and material hardness control. With reference now to FIG. 5, a locking hydraulic actuator according to one embodiment 500 of the present invention will now be described. A hydraulic actuator may include a hydraulic cylinder 510 having an inner radial surface 510*c* defining a cylinder interior volume 509. A main piston 512 may slide within the cylinder 510 in a coaxial manner. The cylinder 510 has a proximal cylinder end 510*a* that is connected to a tailstock housing 520. The cylinder 510 also has a distal cylinder end 510*b*, with an opening through which the main piston 512 slides in normal operation. A cylinder stop surface 510*d* serving to prevent motion of the main piston towards distal cylinder end 510*b* may be formed at the proximal end 510*a* of the cylinder 510, and may contact one or more lock segments 542 when the hydraulic actuator is locked. The stop surface 510*d* may be an annular surface oblique to an exterior radial surface of the cylinder. The cylinder 510 may have an output connection 514, e.g., an aircraft structural attachment bearing, at the proximal cylinder end 510*a*.

The main piston 512 has two ends, a proximal main piston end 512*a*, which is within the cylinder 510 and is closest to the proximal cylinder end 510*a*, and a distal main piston end 512*b*, which may be exterior to the cylinder 510. The main piston 512 may have one or more main piston heads 512*c* that facilitate a hydraulic seal between the main piston 512 and the cylinder 510. The main piston 512 has a lock piston bore 516 that is defined by an interior radial surface 512*d* of the main piston 512. The lock piston bore 516 may be formed within one end of the main piston 512, for example as shown at the proximal main piston end 512*a*. The cylinder distal end 510*b* may be positioned between the proximal piston end 512*a* and the distal piston end 512*b*. The piston 512 may also have an output connection 518, e.g., an actuator output attachment bearing, at the distal piston end 512*b*.

The proximal cylinder end 510*a* is connected to the tailstock housing 520, which has a tailstock housing interior volume 522 defined by a tailstock interior radial surface 524. The tailstock housing 520 may include a lock position indicator mechanism 530 and a locking mechanism 540. The locking mechanism 540 may include the one or more lock segments 542 and a lock piston 544 that fits within the lock piston bore 516. The one or more lock segments 542 are disposed in and are slidable within slots 515 formed in the main piston 512. The tailstock housing interior radial surface 524 and the cylinder inner radial surface 510*c* radially contain the lock segments 542 within the hydraulic actuator. The tailstock housing 520, lock position indicator mechanism 530, and locking mechanism 540 are described with further detail hereafter in reference to FIGS. 6 and 7.

With continuing reference to FIG. 5, a portion of the main piston 512, e.g., the proximal piston end 512*a* and main piston head 512*c*, is within a hydraulic circuit. A portion of the main piston 512 that includes the slots 515 may have a diameter that is smaller than the diameter of the main piston head 512*c*, e.g., between five and ten thousands of an inch, i.e., mils, below the diameter of the main piston head 512*c*. The hydraulic circuit may include a hydraulic pump to pressurize and supply hydraulic fluid to the cylinder 510, and other parts not shown such as one or more retract lines, one or more extend lines, and hydraulic control elements. The hydraulic control elements may include but are not limited to three-way and four-way electrohydraulic servovalves and proportional valves of the closed-center, open-center, or critical-center types, and solenoid valves. The general features of the hydraulic circuit will be obvious to one skilled in the art, and are not shown for the sake of clarity. Within the hydraulic circuit, a pressure difference can be maintained across the relevant portion of the piston, e.g., the proximal piston end 512*a* and main piston head 512*c*, by an adequately close, tight fit or seal between the piston 512 and the cylinder 510. Such a close fit that is adequate to produce a hydraulic seal may be facilitated by one or more main piston seals 513, 513*a* (FIG. 9) that may be present in an annular groove in the circumference of the piston 512. The retract and extend lines may connect to ports, e.g., 517*a*, 517*b*, in the cylinder 510 or tailstock housing 520. The ports 517*a*, 517*b* are connected to passageways for the hydraulic fluid that are formed through the cylinder 510 or tailstock housing 520 to the interior volume defined by the cylinder interior volume 509 and the tailstock interior volume 522 on either side of the hydraulic circuit relative to the main piston seal(s) 513. Hydraulic fluid may pass through ports 553 in the main piston 512 to act on the lock piston on one side of the hydraulic circuit relative to the main piston seal(s) 513. One or more lock piston seals 551 may be present to facilitate a hydraulic seal between the lock piston 544 and main piston 512.

Figure 6:
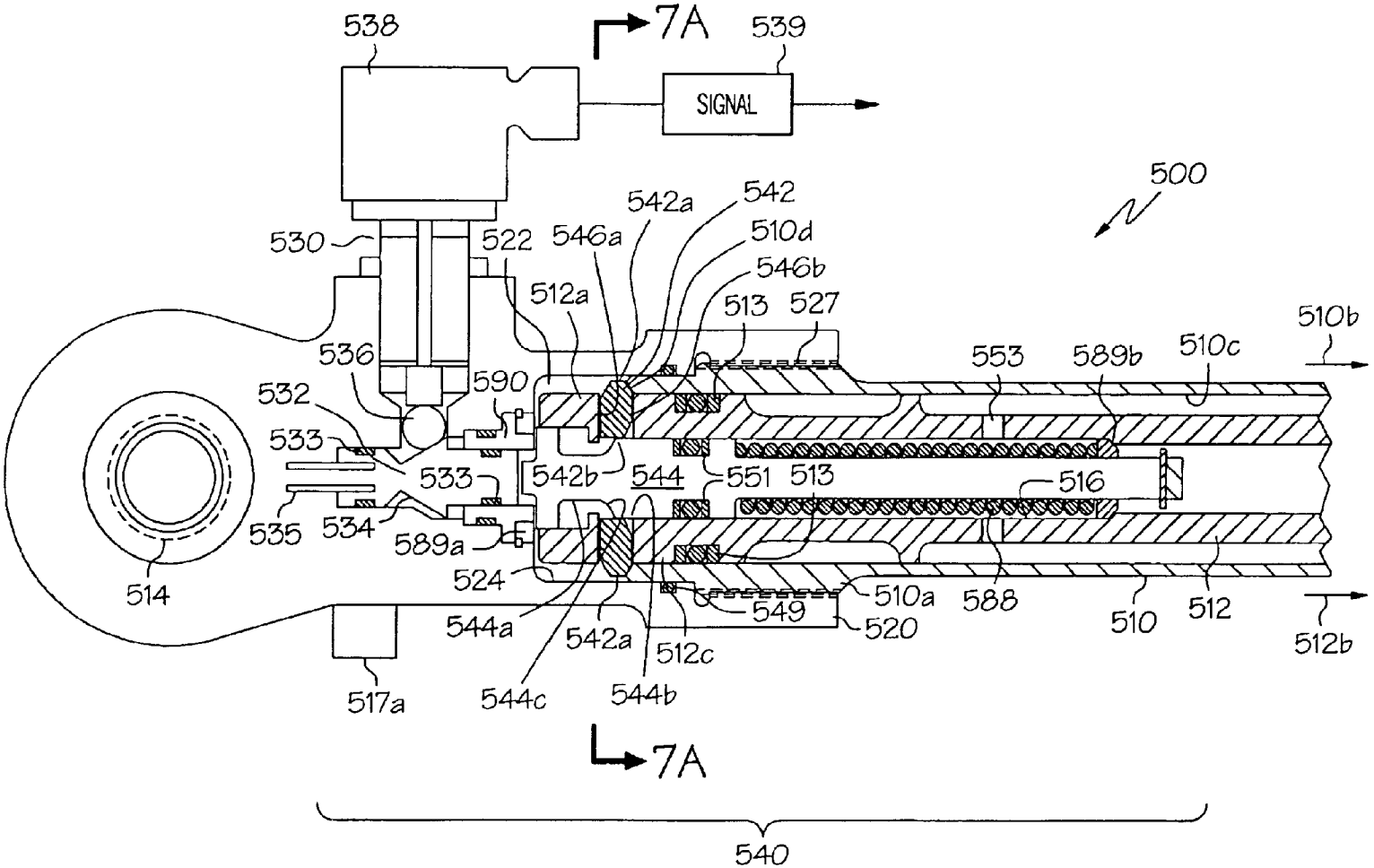
FIG. 6 shows an enlarged cross section view of the locking mechanism of the hydraulic actuator of FIG. 5 in a locked position.

With reference now to FIG. 6, the tailstock housing 520, lock position indicator mechanism 530, and locking mechanism 540 of the locking hydraulic actuator 500 will now be described in further detail. The piston 512 slides within the cylinder 510 and the main piston head 512*c* may slide along the cylinder inner radial surface 510*c*. The tailstock housing 520 may be rigidly connected to the proximal end 510*a* of the cylinder 510 and receives the proximal main piston end 512*a* within the tailstock interior volume 522 defined by the tailstock interior radial surface 524. The tailstock housing 520 may be connected to the cylinder 510 in any way that is sufficient to preserve the hydraulic fluid operating pressure within the tailstock interior volume 522. For example, while a threaded connection 527 is shown, suitable alternatives include a snap fit connection, a welded connection, or functional equivalents. A supplemental high-pressure seal 549 may also be present. The directions of the distal piston end 512*b* and distal cylinder end 510*b* are also shown. An output connection 514 is shown attached to the tailstock housing 520. Also shown is a hydraulic fluid port 517*a* in the tailstock housing 520, and a port 553 in the main piston 512.

The locking mechanism 540 includes the one or more lock segments 542 and the lock piston 544, which slides within the main piston bore 516. The lock piston 544 has a lock piston seal 551 and is connected to the main piston 512 by a coil spring 588. Each of the lock segments 542 has an outer radial face 542*a* and an inner radial face 542*b*, which is shaped to accept the different diameters of the lock piston 544 when the lock piston 544 slides under the inner radial face 542*b* during locking and unlocking. Each of the lock segments 542 also has a proximal straight taper 546*a* and a distal straight taper 546*b*. During normal operation of the locking mechanism, the lock segments 542 transfer forces between; the cylinder and main piston by way of the proximal and distal straight tapers 546*a–b*. When the locking mechanism 540 is in a locked condition, the lock segments 542 transfer loads between the cylinder 510 and main piston. 512 by distributed or line-contact loading and are consequently not subject to point-contact loading. As a result, the lock segments 542 do not become deformed under normal operation conditions, thus preventing undesired unlocking of the locking mechanism 540. The longitudinal movement of the lock piston may be restrained in the distal and proximal directions along the longitudinal axis of the hydraulic actuator by lock piston stops 589*a* and 589*b*, respectively. The lock piston 544 has a first section 544*a* of a first diameter, a second section 544*b* with a second diameter larger that the first section, and an intermediary section 544*c* with a varying diameter between the first and second section. A lock piston seal 551 may be present to ensure a hydraulic seal in the hydraulic circuit within between the proximal and distal sides of the lock piston 544 in the lock piston bore 516. A supplemental seal 590 may also be present.

With continued reference to FIG. 6, a lock position indicator mechanism 530 may also be included. This lock position indicator mechanism 530 is present in preferred embodiments to indicate the locked or unlocked state of the hydraulic actuator to an operator, e.g., a pilot. In preferred embodiments, the lock position indicator mechanism 530 includes a lock position indicator piston 532 that follows the movement of the lock piston 544. The lock position indicator piston 532 may have one or more seals 533, and may be forced to follow the movement of the lock piston 544 by suitable methods, including but not limited to use of hydraulic pressure, direct coupling, a spring 535, or the like. The lock position indicator piston 532 may have a cam surface 534, which may be in contact with an indicator ball 536. A portion of the lock position indicator piston may move within the supplemental seal 590. The cam surface 534 may allow the indicator ball 536 to move radially back and forth from an outward position to an inward position when the lock position indicator piston 532 moves in conjunction with the lock piston 544. The indicator ball 536 may be in a radially outward position when the locking hydraulic actuator 500 is in a locked position. The indicator ball 536 may contact a switch 538 that sends a signal 539 to an operator. The lock position indication signal 539 indicates a locked or unlocked state of the piston 512 within the hydraulic actuator 500.

Figure 7A:
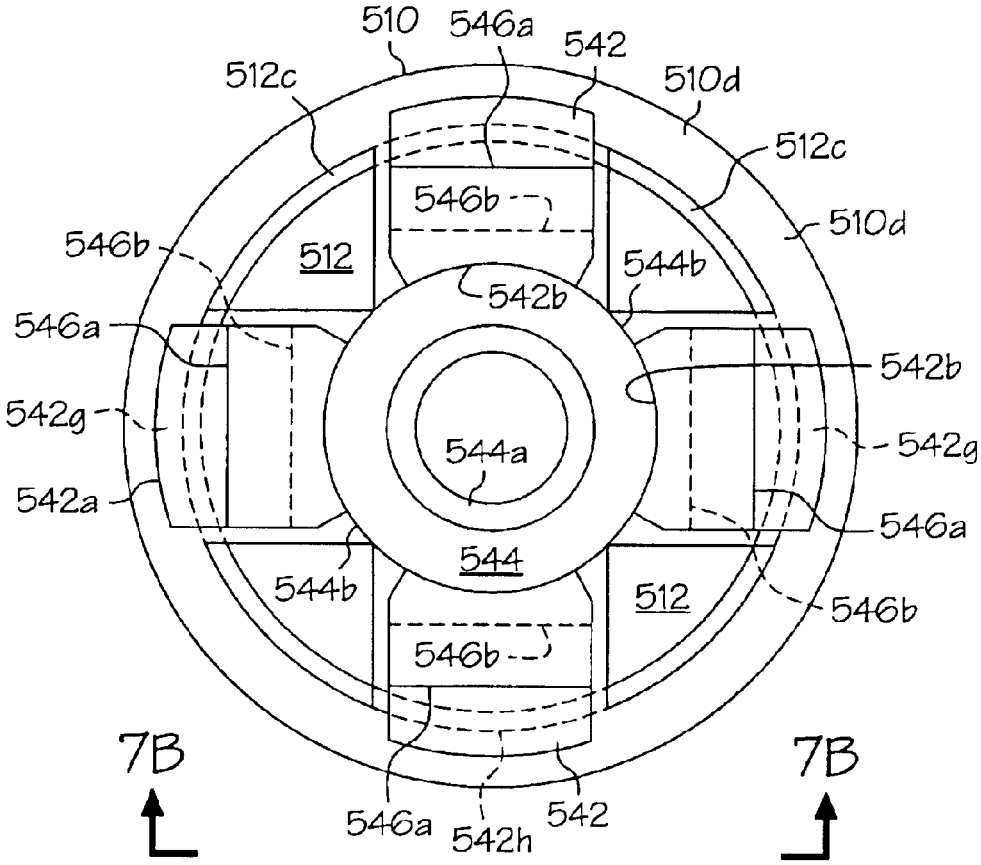
FIG. 7A shows a section view of the locking mechanism of FIG. 6 taken along line 6—6.

Referring now to FIG. 7A, a section view of the locking mechanism of FIG. 6 taken along line 6—6 is shown. Four lock segments 542 are shown in radially extended positions relative to the main piston 512 and the lock piston 544. The outer radial faces 542*a* of the lock segments are shown relative to the cylinder 510 and cylinder stop surface 510*d*. The inner radial faces 542*b* are in contact with the lock piston second section 544*b*, which has a constant diameter that is greater than that of the lock piston first section 544*a*. The outer radial face 542*a* may be flat or curved. Each lock segment 542 may have two lateral sides 542*c*, 542*d*, which in preferred embodiments are parallel to the longitudinal axis of the hydraulic actuator 500 (FIG. 6). Each of the lock segments further include a proximal lock segment face 542*e* and a distal lock segment face 542*f*, toward the proximal main piston end 512*a* and distal main piston end 512*b* shown in FIG. 6, respectively. The proximal and distal lock segment faces may each include two flat faces. The proximal lock segment face 542*e* has a proximal straight taper 546*a*. The distal lock segment face 542*f* has a distal straight taper 546*b*. Each of the lock segments 542 may further have a cylinder-abutting surface 542*g*, and an intersection 542*h*. In FIG. 7A, the piston head 512*c* is shown with a larger diameter than the diameter of the piston 512.

Figure 7B:
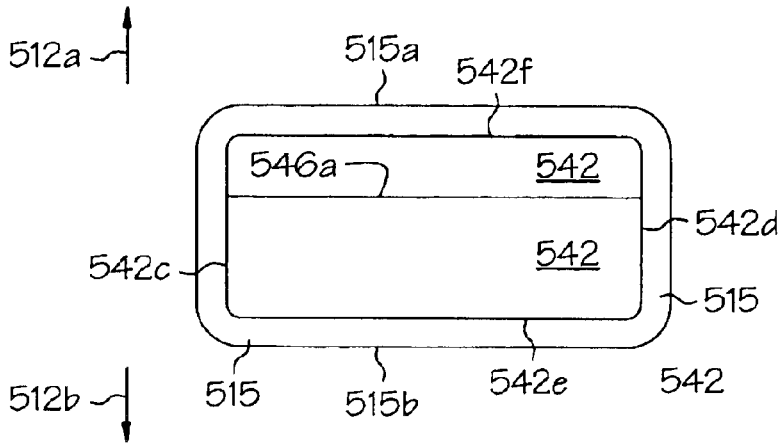
FIG. 7B shows a section view of the locking mechanism of FIG. 7A taken along line 7—7.

As stated previously, each of the lock segments 542 has a proximal straight taper 546*a* and a distal straight taper 546*b*. The straight tapers 546*a*, 546*b* may each include a straight line intersection of two flat faces of each of the proximal lock segment face 542*e* and the distal lock segment face 542*f*, respectively. Each straight taper may also include a surface that is beveled or rounded with respect to each of two flat faces of each of the proximal lock segment face 542*e* and the distal lock segment face 542*f*, respectively. Under axial loading conditions, as the lock segments 542 tend to rotate, the distal straight taper 546*b* transfers axial loads to the distal face 515*b* of the corresponding slot 515 (FIG. 7B). Because the distal straight taper 546*b* may contact the distal slot face 515*b* across the entire width of the lock segment 542, and not just one or two points as in prior art devices, stresses are minimized and dangerous point-contact loading is avoided. The same is true for the proximal straight taper 546*a*, which transfers axial loads to the proximal face 515*a* of the slot 515 across the entire straight taper 546*a*, corresponding to the entire width of the lock segment 542. The presence of the straight tapers 546*a*, 546*b*, allows for a distributed, non-point-load transfer of axial loads of the hydraulic actuator, while accommodating limited rotation of the lock segments 542 within the locking mechanism due to close tolerance control between lock segments 542 and piston slots 515. FIG. 7B shows a section view of the locking mechanism of FIG. 7A taken along line 7—7, and shows the lack of deformation accompanying the use of the present invention as compared to the prior art, as shown in FIG. 1B.

Figure 8A:
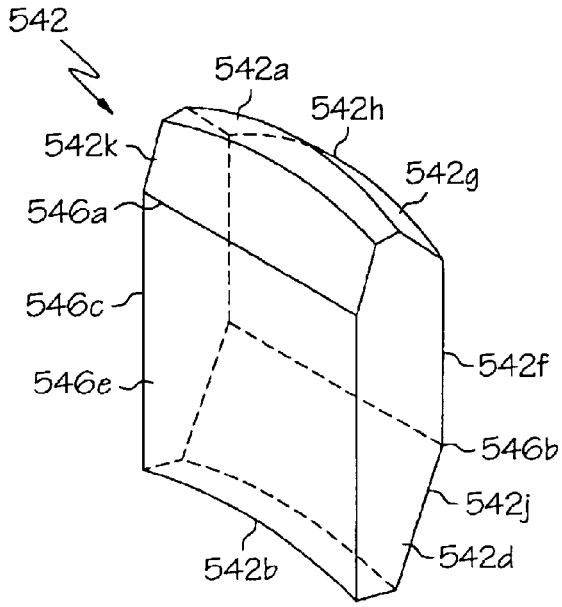
FIG. 8A shows a perspective view of one lock segment of the locking mechanism of FIG.6.
Figure 8B:
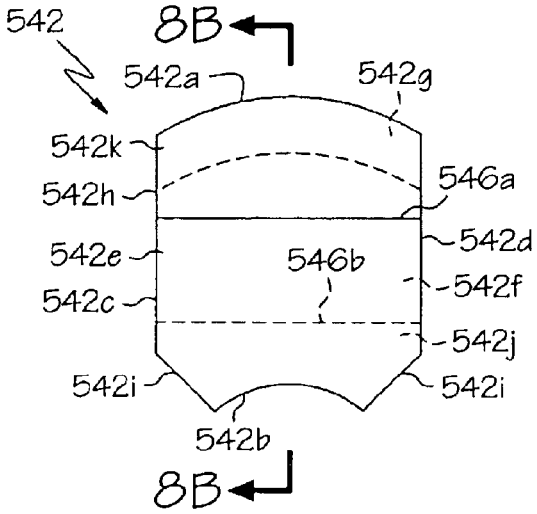
FIG. 8B shows a side view of the lock segment of FIG. 8A.
Figure 8C:
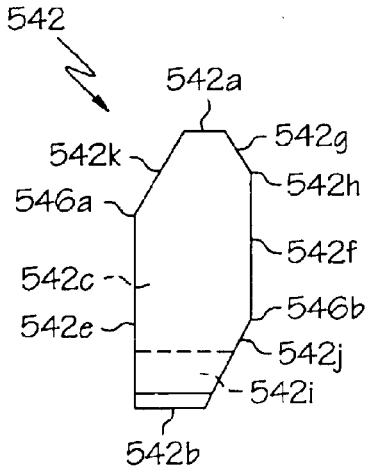
FIG. 8C shows a section view of the lock segment of FIG. 8B taken along line 8—8.

With reference to FIG. 8A, a perspective view of one lock segment 542 of the locking mechanism 540 of FIGS. 5 and 6 is shown. The outer and inner radial faces 542*a*, 542*b* as well as the lateral 542*c*, 542*d*, proximal 542*e*, and distal 542*f* faces are shown. The cylinder-abutting surface 542*g* is shown. The proximal taper 546*a* and distal taper 546*b* are also shown, and may have a straight-line characteristic, which as described may provide for the distribution of axial forces in the hydraulic actuator, thereby avoiding dangerous point-contact loading conditions within the locking mechanism. Each of the lock segments 542 may further have an intersection 542*h*, a lower distal face 542*j*, and an upper proximal face 542*k*. In FIG. 8B, a side view of a lock segment 542 of FIG. 8A is shown. The proximal 546*a* and distal 546*b* straight tapers and the intersection 542*h* of the cylinder-abutting surface 542*g* and the distal face 542*f* are shown. A side taper 542*i* may be present on each of the lateral sides of the lock segment 542. The lower distal face 542*j* and the distal face 542*f* may join at the distal straight taper 546*b*, and the upper proximal face 542*k* and the proximal face 542*e* may join at the proximal straight taper 546*a*. FIG. 8C shows a section view of the lock segment 542 of FIG. 8B, taken along line 8—8. The straight tapers 546*a*, 546*b*, provide distributed loading, e.g., line-loading, across the faces 515*a*, 515*b* of the slots 515 in the main piston 512 as shown in FIGS. 5 and 6.

Figure 9A:
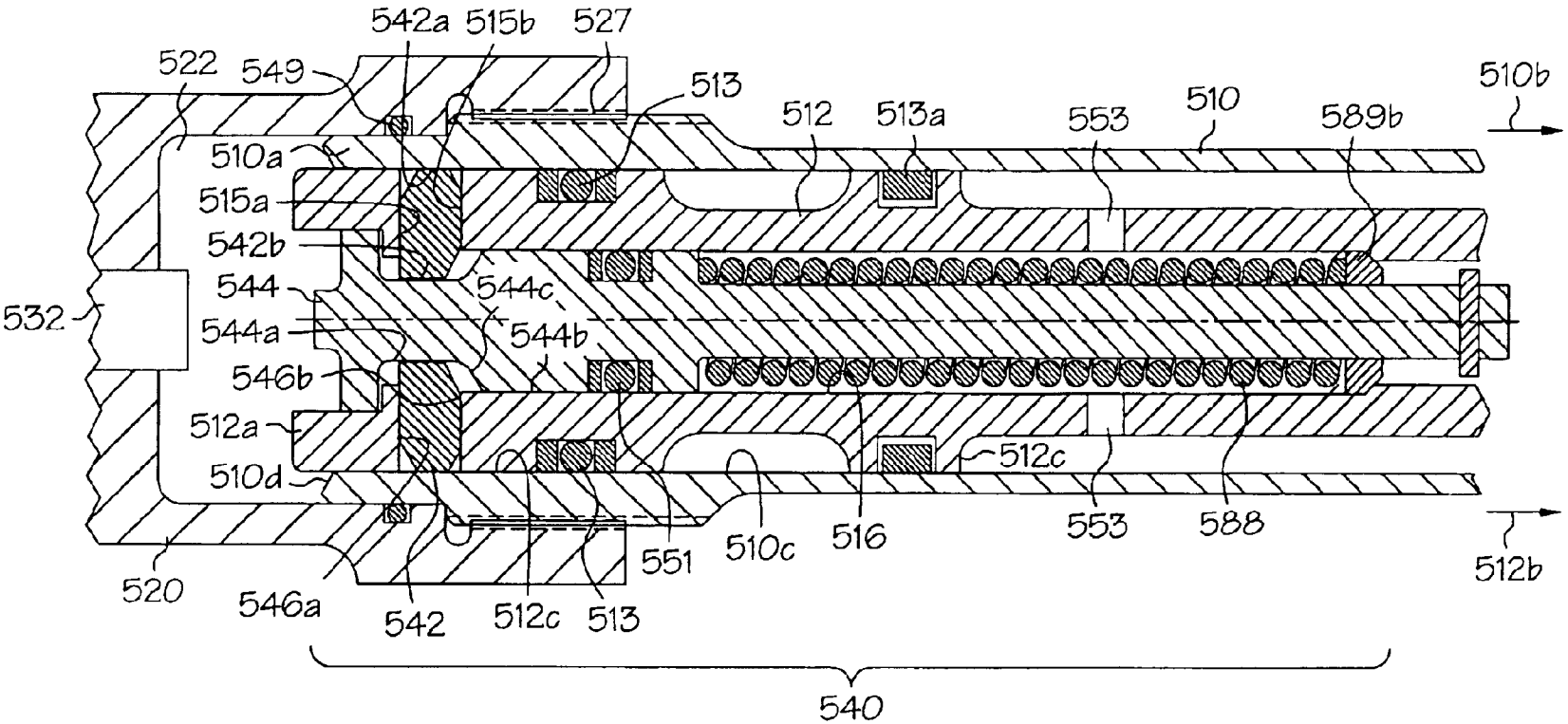
FIG. 9A shows the cross section of FIG. 6 with the locking mechanism in an unlocked position.

Referring now to FIG. 9A, an enlarged view is shown of the locking mechanism 540 of FIGS. 5 and 6 with the locking mechanism 540 in an unlocked position and the piston 512 of the hydraulic actuator partially extended. The proximal cylinder end 510*a* is shown connected to the tailstock housing 520 by the threaded connection 527. In such an unlocked position, the outer radial surfaces 542*a* of the lock segments 542 are within the circumference of the inner radial surface 510*c* of the cylinder 512, allowing the piston 512 to slide along the cylinder 512 in response to the forces of the hydraulic circuit. In its unlocked position, the lock piston 544 is moved toward the distal main piston end 512*b* along the longitudinal axis of the hydraulic actuator relative to the locked position. The lock position indicator piston 532 is shown at its unlocked position. This position of the lock piston 544 allows the inner radial surfaces 542*b* of the lock segments 542 to move radially inward to engage the first section 544*a* of the lock piston 544 with its first diameter, which is smaller that the second diameter of the second section 544*b*. The lock segments 542 may be forced radially inward by contact with the cylinder lock surface 510*d*, which movement disengages the outer radial surfaces 542*a* of the lock segments from contact with the inner radial surface 510*c* of the cylinder. The directions of the distal piston end 512*b* and distal cylinder end 510*b* are also shown.

Figure 9B:
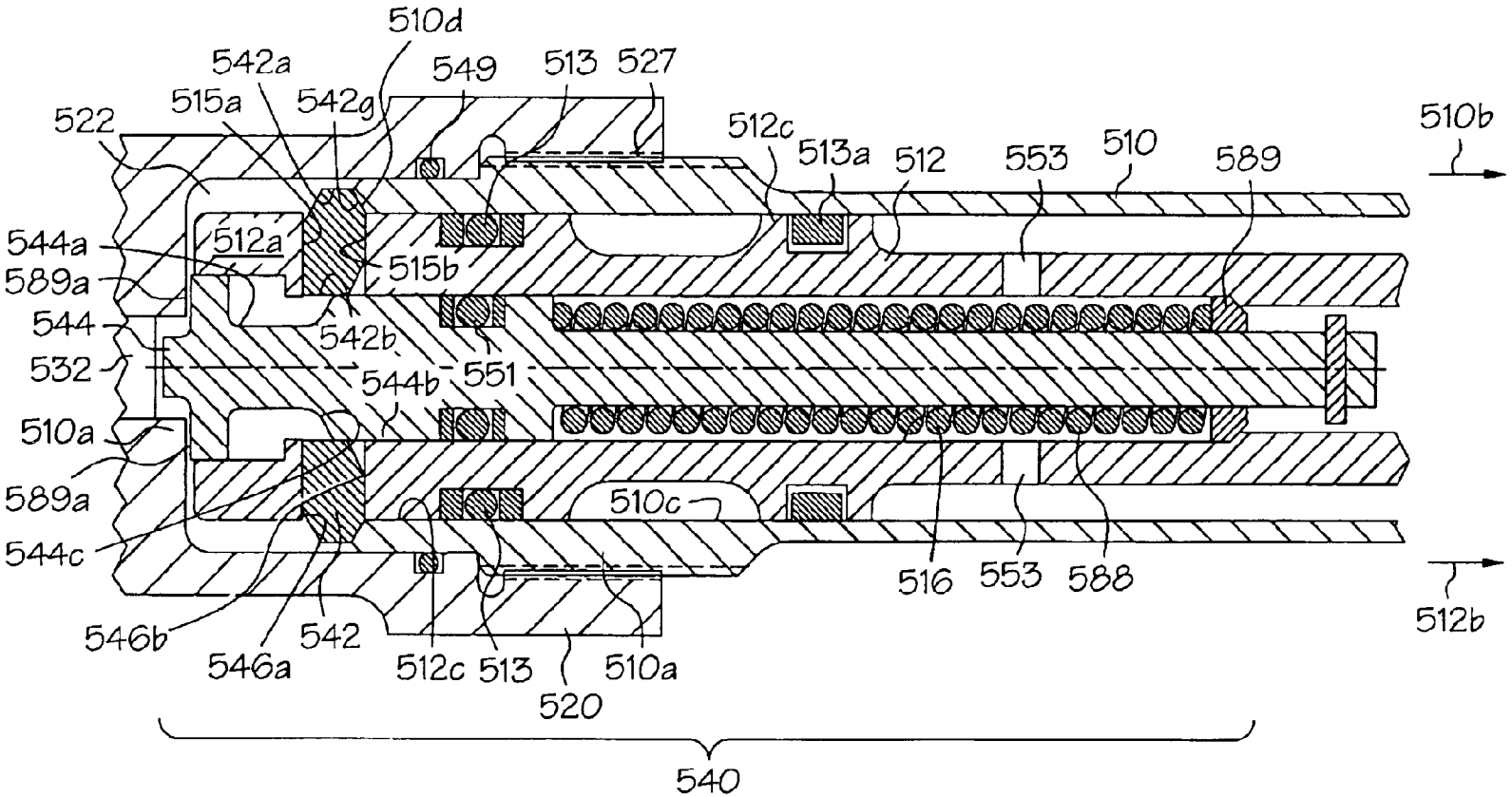
FIG. 9B shows an enlarged view of the cross section of FIG. 6 with the locking mechanism in a locked position and the hydraulic actuator under a tensile axial loading condition.

FIG. 9B shows an enlarged view the locking mechanism of FIGS. 5 and 6 with the hydraulic actuator under tensile axial loading and in a locked position. The lock piston 544 is shown in contact with the position indicator piston 532, which is at its locked position. As can be seen, under such loading, the proximal 546*a* and distal 546*b* straight tapers of the lock segments 542 transfer the axial forces through contact with the proximal 515*a* and distal 515*b* faces, respectively, of the slots 515 in the main piston 512. Because the straight tapers 546*a*, 546*b* are in contact across their entire width with the corresponding face of the slot 515, distributed loading occurs across both the face of the slot 515 and the lock segment 542, and as a result the deformations associated with point-contact loading are mitigated. The locking mechanism 540 is consequently able to repeatedly withstand tensile and cyclic axial loading of the hydraulic actuator without deleterious deformation of the locking mechanism parts.

Operation of the locking hydraulic actuator 500 will now be described with parts as shown in FIGS. 5–9. A controlled increase in pressure of the hydraulic fluid on one side of the main piston seal 513 with respect to the other side causes the main piston 512 to slide within the cylinder 510. The pressure difference is controlled by an operator, e.g., a pilot, by appropriate hydraulic controls including but not limited to three-way and four-way electrohydraulic servo valves of the closed-center, open-center, or critical-center types or two-way or three-way solenoid valves. When the operator controls the main piston 512 to retract, the pressure in the hydraulic pressure increases on the distal side of the main piston seal 513 and the main piston 512 along with the lock piston 544 are pushed toward the proximal end of the cylinder 510*a*. The outer radial surface of the lock piston 544 is pushed into contact with the lock segments 542, which are retained along the longitudinal axis of the hydraulic actuator by the slots 515. As the lock piston 544 is pushed to its locked position, the inner radial surfaces 542*b* of the lock segments 542 are contacted by the first 544*a*, intermediary 544*c*, and second 544*b* sections of the lock piston in succession. Because the diameter of the lock piston 544 may increase in a continuous fashion from the first section 544*a* to the second section 544*b*, the lock segments 542 are pushed radially outward in the slots 515 by the lock piston 544. Thus, the locking mechanism 540 locks the main piston 512 relative to the cylinder 510. When present, the lock position indicator mechanism 530 may then be triggered by the position of the lock piston 544 to send a signal 539 that the main piston 512 is locked relative to the cylinder 510. Axial forces exerted on the hydraulic actuator with the locking mechanism in the locked position arc safely transmitted from the main piston 512 to cylinder 510 through the locking mechanism 540, which remains locked, without considerable deformation of the locking mechanism parts. Any minimal deformation that may occur does not result in failure of the locking mechanism 540.

When it is desired to unlock the main piston 512, the pressure in the hydraulic fluid on the proximal side of the main piston seal 513 is increased, and the lock piston 544 is forced toward the distal end of the lock piston bore 516. The lock piston 544 transfers some force to the main piston 512 by compressing the spring 588. Additional force is transmitted to the main piston 512 as hydraulic fluid circulates past the lock piston 544 to act on the main piston 512 and main piston seal 513. A portion of the combined force on the main piston 512 is transmitted by the stop surface 510*d* of the cylinder 510 to the cylinder-abutting faces 542*g* of the lock segments 542. When the second section 544*b* of the lock piston 544 clears the inner radial faces 542*b* of the lock segments, the lock segments 542 are forced to slide radially inward along the surface of the intermediary section 544*c*. At a certain point along the radial movement of the lock segments 542, the outer radial surfaces 542*a* of the lock segments clear the outer radial surface 512*c* of the main piston 512, at which point the main piston 512 becomes unlocked, as shown in FIG. 9A, and is free to slide within the cylinder 510 according to however the hydraulic circuit is controlled. When the lock piston 544 moves away from its position in the locked condition of the hydraulic actuator, the lock position indicator piston 532 moves with the lock piston 544, and a signal 539 is produced by the lock position indicator mechanism 530 indicating that the main piston 512 is unlocked within the cylinder 510.

With reference now to FIGS. 5–9, one use of the present invention will now be described. The cylinder and piston output connections shown may be connected to components of a structure or a machine, e.g., an airplane. For example, the actuator output bearing 518 shown in FIG. 5 may be connected to the nose landing gear of an airplane. The aircraft structural attachment bearing 514 may be connected to the aircraft structure. When the main piston 512 is in the extend position, the landing gear is stowed. When the main piston 512 in the hydraulic actuator is controlled to move into the retract position by the pilot, the landing gear is deployed to a position that is substantially perpendicular to the fuselage of the aircraft and in a proper position for aircraft landing.

As the main piston 512 moves fully into the retract position, the lock piston 544 pushes the lock segments 542 radially outward within the slots 515 to contact the inner radial surface 510*c* of the cylinder. The main piston 512 is at this point prevented from further longitudinal movement towards the tailstock housing 520 by the tailstock housing 520 itself, with the lock piston being stopped in this direction by lock piston stop 589*a*. The main piston 512 is prevented from movement toward the distal end 510*b* of the cylinder 510 by the cylinder-abutting surfaces 542*g* of the lock segments 542 abutting against the cylinder stop surface 510*d*. Thus, the locking mechanism 540 locks the main piston 512 relative to the cylinder 510. The lock position indicator mechanism 530 may then be triggered by the position of the lock piston 544 to send a signal 539 to the pilot indicating that the piston 512 is locked and that the landing gear is deployed and securely locked.

Upon the landing of the plane, the axial forces that are absorbed by the landing gear are safely transmitted from the main piston 512 to cylinder 510 through the locking mechanism 540, which remains locked, without appreciable deformation of locking mechanism parts. When it is desired to unlock the piston, for example after the aircraft is safely in flight, the pressure in the hydraulic fluid on the proximal side of the main piston seal 513 is increased, and the lock piston 544 is forced toward the distal end of the main piston bore 516. The lock piston 544 transfers some force to the main piston 512 by compressing the spring 588. Additional force is transmitted to the main piston 512 as hydraulic fluid circulates past the lock piston 544 to act on the main piston 512 and main piston seal 513. A portion of the combined force on the main piston 512 is transmitted by the cylinder end face 510*d* to the cylinder-abutting surfaces 542*g* of the lock segments 542. When the second section 542*b* of the lock piston 544 clears the inner radial faces 542*b* of the lock segments, the lock segments 542 are forced to slide radially inward along the surface of the intermediary section 544*c*. At a certain point along the radial movement, the outer radial surfaces 542*a* of the lock segments clear the outer radial surface of the main piston 512, at which point the main piston 512 becomes unlocked and is free to slide within the cylinder 510 according to however the hydraulic circuit is controlled. As the lock position indicator piston 532 moves with the lock piston in this situation, a signal 539 is sent to the pilot indicating that the piston 512 is unlocked within the cylinder.

The present invention thus has superior locking capabilities when compared with previous locking hydraulic actuators, particularly when an apparatus in accordance with the present invention is subject to cyclic axial loading conditions, for example, as experienced by an aircraft landing system during landing.

In certain embodiments, the materials of the lock segments and lock piston are materials that have or are treated to have a hardness that is greater than that of the parts in the locking mechanism that contact the one or more lock segments. In preferred embodiments, the one or more lock segments and lock cylinder have a surface hardness greater than the parts in the locking mechanism that engage or contact the lock segments by five units of hardness as measured on the Rockwell C hardness scale. Furthermore, in preferred embodiments, all of the different parts of the locking mechanism have a differing hardness to minimize galling of the parts within the locking mechanism, with the possible though not required exception that the lock segments may have the same hardness as the lock piston.

In preferred embodiments the piston and cylinder may be made of AISI 4340 alloy steel that has been heat treated to a yield strength of 180 ksi, where "AISI" is an acronym standing for the American Iron and Steel Institute. In preferred embodiments, the tailstock housing may be made of 7075-T73 aluminum alloy. The lock position indicator piston may be made of AISI 440C corrosion resistant steel with a hardness of 58–62 on the Rockwell C hardness scale. The lock position indicator piston may be made from 440C corrosion resistant steel with a hardness less than the indicator ball. In preferred embodiments, the lock piston may be made from AISI E52100 chrome alloy tool steel heat treated to a hardness of 60 to 65 on the Rockwell C hardness scale. In preferred embodiments, the one or more lock segments are selected from AISI type S-5 tool steel heat treated to a hardness of 58 to 60 on the Rockwell C hardness scale. A lock piston stop may be made from 300 series corrosion resistant steel, and the indicator ball may be made from heat treated 440C corrosion resistant steel. In preferred embodiments, the cylinder stop surface may be induction-hardened to a hardness of 54–56 on the Rockwell C hardness scale.

In preferred embodiments, the portion of the main piston that includes the slots may have a diameter that is between five and ten thousands of an inch, i.e., mils, below the main piston head diameter. Maximizing the diameter of the main piston in this manner increases the surface area of the slot faces and the area over which forces can be distributed to the lock segments. Also in preferred embodiments, the lock segments and the slots may have a clearance that is between one-half and three mils. By minimizing the clearance with the lock segments in this manner, lock segment rotation is minimized.

Although the present invention has been described in considerable detail with reference to certain preferred version thereof, other versions are possible. For example, while the previously described embodiments of the present invention are directed to use with hydraulic fluid, one of skill in the art will understand that the scope of the present invention includes use of compressed air or gas. Additionally, while use of four lock segments was described, the present invention can include use of one or more lock segments with no particular upper limit to the number of lock segments that can be used. Furthermore, while the previous description of embodiments of the present invention is directed to a single-rod hydraulic actuator, double-rod actuators, e.g., dual-tandem, dual-parallel, etc., may of course be substituted within the scope of the present invention. While the main piston has been shown and described as having a hollow portion for weight minimization, the piston may be solid.

Additionally, while a coil spring has been described as an appropriate means for elastic coupling between the lock piston and main piston, any other suitable means for elastic coupling may be substituted, for example various other types of springs. While the tailstock housing and the cylinder have been described as being two components that are coupled together, the two may be formed as one integral cylinder housing. The piston may include a group of connected parts, which may be contained within the cylinder, coupled to an output rod. The manufacturing of slots may he performed by electrical discharge machining (EDM) techniques or other suitable techniques. Suitable alternatives include but are not limited to laser cutting or drilling, plasma arc torching, broaching, machining, and water jet cutting. Other suitable lock position indicator mechanisms may be used in the alternative of the one described. Therefore, the spirit and scope of the appended claims should not be limited to the description of the preferred versions contained herein.

The reader's attention is directed to all papers and documents that are filed concurrently with this specification and which are open to public inspection with this specification, and the contents of all such papers and documents are incorporated herein by reference. All the features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalents or similar features.

Any element in a claim that does not explicitly state "means for" performing a specific function, is not to be interpreted as "means" or "step" clause as specified in 35 U.S.C. § 112, paragraph 6.

What is claimed is:

1. A locking hydraulic actuator comprising:

a cylinder having an inner radial surface, a longitudinal axis, and a cylinder stop surface;

a main piston slidingly disposed within said cylinder and having a lock piston bore, said main piston having one or more slots therethrough disposed from an outer radial surface to said lock piston bore, wherein said main piston is movable along said longitudinal axis;

a lock piston slidably disposed within said lock piston bore from a first position to a second position in either direction along said longitudinal axis, said lock piston having a first section with a first diameter, and a second section with a second diameter greater than said first diameter;

an elastic coupler connecting said main piston to said lock piston, wherein said elastic coupler preloads said lock piston in one direction; and one or more lock segments disposed within said one or more slots and having a proximal straight taper and a distal straight taper and a cylinder-abutting surface, each of said one or more lock segments having an outer radial surface and an inner radial surface, a first and a second lateral face, and a proximal face and a distal face, said one or more lock segments being radially moveable from a locked position wherein each of said cylinder-abutting faces contacts said cylinder stop surface and wherein said main piston is immovable along said longitudinal axis to an unlocked position, wherein said one or more lock segments transfer forces between said piston and said cylinder by distributed loading.

2. The locking hydraulic actuator of claim 1, further comprising a tailstock housing connected to said cylinder.

3. The locking hydraulic actuator of claim 2, further comprising a hydraulic circuit operable to supply and receive hydraulic fluid to and from said cylinder to move said main piston relative to said cylinder.

4. The locking hydraulic actuator of claim 3, wherein said hydraulic circuit comprises a first hydraulic port and a second hydraulic port in said cylinder.

5. The locking hydraulic actuator of claim 1, wherein in said locked position said cylinder-abutting surface contacts said stop surface, and wherein each said inner radial face contacts said second section, each of said proximal tapers contacts a corresponding proximal slot face, and each of said distal tapers contacts a corresponding distal slot face, wherein in said unlocked position each of said inner radial faces contacts said first section.

6. The locking hydraulic actuator of claim 5, wherein said main piston further comprises a main piston head having a main piston head diameter.

7. The locking hydraulic actuator of claim 6, wherein said piston head diameter exceeds said main piston diameter in said cylinder by about 5 mils to about 10 mils.

8. The locking hydraulic actuator of claim 6, wherein a clearance between said each of said one or more lock segments and a corresponding slot is between about one-half mil to about three mils.

9. The locking hydraulic actuator of claim 5, wherein each said proximal straight taper comprises an intersection of two flat faces of said proximal face.

10. The locking hydraulic actuator of claim 5, wherein each said distal straight taper comprises an intersection of two flat faces of said distal face.

11. The locking hydraulic actuator of claim 5, wherein each said proximal straight taper comprises a beveled intersection of two flat faces of said proximal face.

12. The locking hydraulic actuator of claim 5, wherein each said distal straight taper comprises a beveled intersection of two flat faces of said distal face.

13. The locking hydraulic actuator of claim 5, wherein each said proximal straight taper comprises a rounded intersection of two flat faces of said proximal face.

14. The locking hydraulic actuator of claim 5, wherein each said distal straight taper comprises a rounded intersection of two flat faces of said distal face.

15. The locking hydraulic actuator of claim 5, further comprising a lock position indicator mechanism in communication with said lock piston.

16. The locking hydraulic actuator of claim 15, wherein said lock position indicator mechanism comprises:

a lock position indicator piston in communication with said lock piston and moveable from a locked position corresponding to said locked position of said lock piston to an unlocked position corresponding to said unlocked position of said lock piston, said lock position indicator piston having a cam surface with a diameter varying from a first diameter to a second diameter larger than said first diameter;

a lock position ball in contact with said lock position indicator piston, wherein said lock position indicator ball is disposed within a bore within a tailstock housing and moveable from a first position in said bore to a second position in said bore; and a switch operable to produce a locked signal or an unlocked signal, wherein said switch is in contact with said ball;

wherein said switch produces said locked signal in response to said lock position ball moving from said first position to said second position upon force of said cam surface as said lock position indicator piston is moved to said locked position from said unlocked position.

17. The locking hydraulic actuator of claim 16, wherein said switch produces said unlocked signal in response to said lock position ball moving from said second position to said first position as said cam surface moves as said lock position indicator piston is moved from said locked position to said unlocked position.

18. The locking hydraulic actuator of claim 17, further comprising a bias spring tending to force said lock position indicator piston to said unlocked position.

19. The locking hydraulic actuator of claim 18, further comprising a bias spring in said switch tending to force said lock position ball away from said switch.

20. The locking hydraulic actuator of claim 5, wherein said one or more lock segments have a lock segment material hardness, said cylinder has a cylinder material contact surface hardness, and said main piston has a main piston material contact surface hardness, wherein said main piston material contact surface hardness is different from each of said lock segment material hardness and said cylinder material contact surface hardness, and said lock segment hardness is different from said cylinder material contact surface hardness.

21. The locking hydraulic actuator of claim 20, wherein said lock segment material hardness is between about 58 to about 60 on a Rockwell C hardness scale.

22. The locking hydraulic actuator of claim 20, wherein said cylinder material contact surface hardness is between about 52 to about 56 on a Rockwell C hardness scale.

23. The locking hydraulic actuator of claim 20, wherein said lock piston has a lock piston hardness different from each of said lock segment material hardness and said cylinder material contact surface hardness, and said lock segment material hardness is different from said cylinder material contact surface hardness.

24. The locking hydraulic actuator of claim 23, wherein said lock piston hardness is between about 60 to about 65 on a Rockwell C hardness scale.

25. The locking hydraulic actuator of claim 20, wherein said one or more lock segments are made of type AISI S-5 tool steel.

26. The locking hydraulic actuator of claim 20, wherein said lock piston is made of type AISI E52100 steel.

27. The locking actuator of claim 1, wherein said lock piston further comprises an intermediary section with a diameter that varies from said first diameter to said second diameter.

28. The locking hydraulic actuator of claim 1, wherein said diameter of said second section is constant.

29. The locking hydraulic actuator of claim 1, wherein said elastic coupler comprises a spring.

30. In a locking hydraulic actuator of the type in which a main piston is slidably disposed within a cylinder, and wherein said main piston has a main piston diameter and a lock piston slidably disposed within said main piston, and wherein one or more lock segments are radially slidingly disposed within slots in said main piston and radially moveable from a locked position to an unlocked position, wherein the improvement comprises:

a proximal straight taper disposed on a proximal face of each lock segment, and a distal straight taper disposed on a distal face of each lock segment, wherein said proximal straight taper transmits and distributes stresses of an axial load developed in said locking hydraulic actuator across said width of said lock segment to said proximal face of said slot, and wherein said distal straight taper transmits and distributes stresses of said axial load developed in said locking hydraulic actuator across said width of said lock segment to said distal face of said slot.

31. The improvement of claim 30, wherein said one or more lock segments have a lock segment material hardness, said cylinder has a cylinder material contact surface hardness, and said main piston has a main piston material contact surface hardness, wherein said main piston material contact surface hardness is different from each of said lock segment material hardness and said cylinder material contact surface hardness, and said lock segment material hardness is different from said cylinder material contact surface hardness.

32. The improvement of claim 30, wherein said main piston has a main piston head having a main piston head diameter in said cylinder that exceeds a diameter of said main piston by about 5 mils to about 10 mils.

33. The locking mechanism of claim 32, wherein a diameter of a piston head exceeds a main piston diameter in said cylinder by about 5 mils to about 10 mils.

34. The locking mechanism of claim 33, further comprising a bias spring tending to force said lock position indicator piston to said unlocked position.

35. The locking mechanism of claim 32, wherein a clearance between said each of said one or more lock segments and a corresponding slot is between about one-half mil to about three mils.

36. The improvement of claim 30, wherein said clearance between said each of said one or more lock segments and a corresponding slot is between about one-half mil to about three mils.

37. A locking mechanism for a piston and cylinder assembly, said locking mechanism comprising:

a lock piston slidingly disposed within said piston of said piston and cylinder assembly; and one or more lock segments disposed in one or more corresponding slots disposed through said piston from an outer radial surface to an inner radial surface, said one or more lock segments each having a proximal face having a proximal straight taper, a distal face having a distal straight taper, and a width, said one or more slots each having a proximal face and a distal face, wherein said proximal straight taper transmits and distributes stresses of an axial load developed in said piston and cylinder assembly across said width of said lock segment to said proximal face of said slot, and wherein said distal straight taper transmits and distributes stresses of said axial load developed in said piston and cylinder assembly across said width of said lock segment to said distal face of said slot, and wherein said one or more lock segments, in response to movement of said lock piston, are moveable radially from a locked position wherein said piston is locked within said cylinder to an unlocked position wherein said piston is moveable within said cylinder.

38. The locking mechanism of claim 37, further comprising a lock position indicator mechanism in communication with said lock piston.

39. The locking mechanism of claim 38, wherein said lock position indication mechanism comprises:

a lock position indicator piston in communication with said lock piston and moveable from a locked position corresponding to said locked position of said lock piston to an unlocked position corresponding to said unlocked position of said lock piston, said lock position indicator piston having a cam surface with a diameter varying from a first diameter to a second diameter larger than said first diameter;

a lock position ball in contact with said lock position indicator piston, wherein said lock position indicator ball is disposed within a bore within a tailstock housing and moveable from a first position in said bore to a second position in said bore; and a switch operable to produce a locked signal or an unlocked signal, wherein said switch is in contact with said lock position ball;

wherein said switch produces said locked signal in response to said lock position ball moving from said first position to said second position upon force of said cam surface as said lock position indicator piston is moved to said locked position from said unlocked position.

40. The locking mechanism of claim 39, wherein said switch produces said unlocked signal in response to said lock position ball moving from said second position to said first position as said cam surface moves as said lock position indicator piston is moved from said locked position to said unlocked position.

41. The locking mechanism of claim 39, further comprising a bias spring in said switch tending to force said lock position ball away from said switch.

* * * * *